United States Patent [19]

Caputo

[11] Patent Number: 4,738,337

[45] Date of Patent: Apr. 19, 1988

[54] METHOD AND APPARATUS FOR PROVIDING A LOAD COMPENSATION SIGNAL FOR A TRACTION ELEVATOR SYSTEM

[75] Inventor: William R. Caputo, Wyckoff, N.J.

[73] Assignee: Westinghouse Electric Corp., Pittsburgh, Pa.

[21] Appl. No.: 79,201

[22] Filed: Jul. 29, 1987

[51] Int. Cl.[4] ..... B66B 1/44

[52] U.S. Cl. ..... 187/115; 187/116

[58] Field of Search ..... 187/115, 116, 131

[56] References Cited

U.S. PATENT DOCUMENTS

| | | | |
|---|---|---|---|
| 3,244,957 | 4/1966 | Spiess et al. | 187/115 X |
| 3,486,101 | 12/1969 | Rufli | 187/115 X |
| 3,614,996 | 10/1971 | Saito et al. | 187/115 |
| 4,042,068 | 8/1977 | Ostrander et al. | 187/115 |
| 4,380,275 | 4/1983 | Kähklpuro | 187/115 |
| 4,452,341 | 6/1984 | Tanahashi | 187/131 X |

*Primary Examiner*—William M. Shoop, Jr.
*Assistant Examiner*—W. E. Duncanson, Jr.
*Attorney, Agent, or Firm*—D. R. Lackey

[57] ABSTRACT

A method and apparatus for providing a load compensation signal for the drive motor control loop of a traction elevator system which includes an elevator car having a load responsive platform and a counterweight. The load compensation signal transfers unbalanced torque from the system brake to the drive motor at the start of the run, to provide smooth starts. The load compensation signal is heavily filtered to provide a response time which will follow changes in car loading but too slow to affect car dynamics. Thus, the load compensation signal is continuously connected to the motor control loop, eliminating switches and memories, and enabling the compensation signal to directly aid car landing. Non-linearities in the load responsive platform are partially compensated for by three initial adjustments, and a fourth adjustment is provided for periodically offsetting changes due to ageing of platform isolation materials.

The load compensation signal may be added directly to the motor control loop, or further processed to account for hoist cable weight compensation error at the location of the elevator car.

15 Claims, 5 Drawing Sheets

METHOD AND APPARATUS FOR PROVIDING A LOAD COMPENSATION SIGNAL FOR A TRACTION ELEVATOR SYSTEM

TECHNICAL FIELD

The invention relates in general to traction elevator systems which include an elevator car and counterweight mounted for guided movement in the hatch of a building, and more specifically to methods and apparatus for providing a load compensation signal for the motor control loop of a traction elevator system for aiding starting and stopping of the elevator car.

BACKGROUND ART

The load in an elevator car of a traction elevator system has been used by the car and/or group supervisory control for such control strategy functions as controlling by-passing of hall calls, initiating the start of the "next" car from a building lobby, initiating system "down peak", initiating special floor features, susch as convention floor strategy, and the like.

Unbalanced car load, i.e., a load, or lack of load, which either causes the weight on the car side of the traction ropes to exceed the weight on the counterweight side, or vice versa, has been detected and used to improve car dynamics, such as for providing smoother car starts and more accurate and faster landings.

The drive related compensation signals, related to unbalanced load, and the supervisory signals, related to actual car load relative to rated car load, are usually independently obtained.

A common arrangement for obtaining the supervisory signals resiliently mounting the car platform and measuring the platform deflection or position. While this is accurate enough for supervisory purposes, the non-linearity of the platform isolation material, as well as permanent deformation of such materials due to ageing, introduce errors which would adversely affect car dynamics. Also, car load alone may not accurately reflect unbalanced torque in every instance, as the weight of the hoist ropes may not be compensated for; or, even when compensation is provided for the weight of the hoist ropes, it will usually have an error, which error is dependent upon car position in the building.

Thus, it would be desirable to be able to derive car loading signals for both supervisory and motor control functions from car platform position, if the hereinbefore mentioned problems associated with hoist rope compensation error and the non-linearity and aging of platform isolation materials can be satisfactory solved.

DISCLOSURE OF THE INVENTION

Briefly, the present invention relates to methods and apparatus for enabling car platform position, which is isolated from the sling and made car load responsive, to be accurately used for developing an unbalanced load compensation signal for the motor control loop of a traction elevator system. The platform position is also used to provide per cent car load signals for use by the car or system supervisory control.

The controller for providing the load compensation signal partially compensates for the non-linearities of the platform isolation materials by the initial sequential adjustment of three potentiometers at prescribed loads in the car, only one of which is carried by the elevator car. Signal change due to ageing of th isolation material is compensated for by a fourth potentiometer located in the controller. Thus, once the potentiometer or transducer carried by the elevator car which measures platform position is calibrated or initially set, it is locked in the set position and need not be accessed by maintenance personnel.

Aging compensation is provided by a simple procedure in which th elevator car is parked at mid-hatch, a load is placed in the car which causes the car to balance the weight of the counterweight, hereinafter simply referred to as a "balanced load", the voltage difference between two circuits points in the motor controller is measured, and the fourth potentiometer is adjusted, if necessary, to return this voltage difference to zero.

The car load compensation signal may be used directly to indicate unbalanced torque, or it may be processed to account for error in hoist rope compensation.

BRIEF DESCRIPTION OF THE DRAWINGS

The invention may be better understood and further advantages and uses thereof more readily apparent when considered in view of th following detailed description of exemplary embodiemnts, taken with the accompanying drawings, in which.

DESCRIPTION OF PREFERRED EMBODIMENTS

Figure 1:
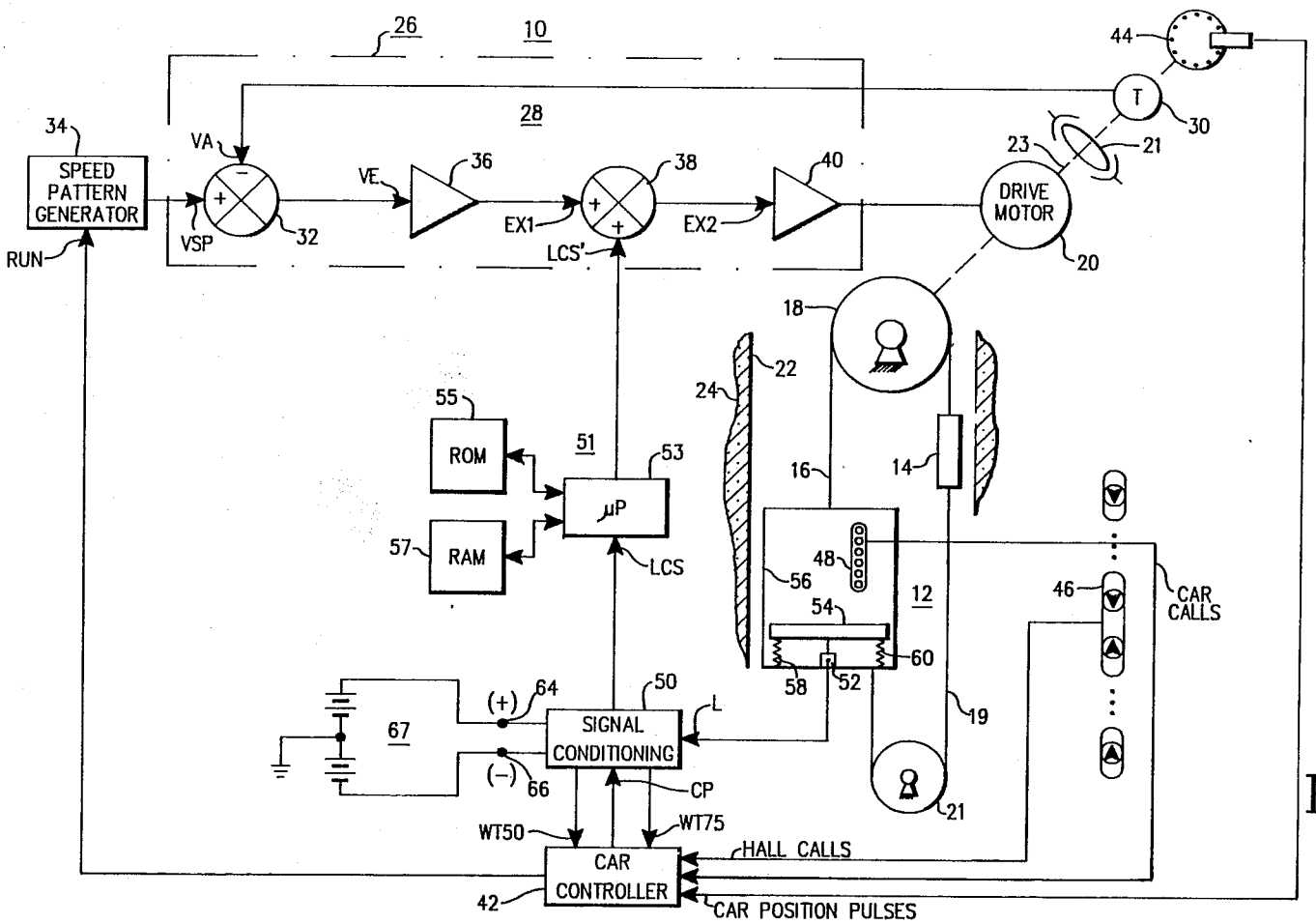
FIG. 1 is a diagrammatic representation of a traction elevator system which may be constructed and operated according to the teachings of the invention.

Referring now to the drawings, and to FIG. 1 in particular, there is shown a traction elevator system 10 which may be constructed and operated according to the teachings of the invention. Traction elevator system 10 includes an elevator car 12 connected to a counterweight 14 via a plurality of wire hoist ropes 16. Hoist ropes 16 are reeved about a traction drive sheave 18. Drive sheave 18 is coupled, either directly or via suitable reduction gearing, to an AC or DC drive motor 20. A brake 21, such as a drum or disc brake is coupled to the motor drive shaft, which is represented by broken line 23. Elevator car 12 and counterweight 14 are mounted for guided vertical movement in the hatch 22 of a building 24 via suitable guide rails (not shown). Compensation ropes 16 may be connected from the bottom the elevator car 12 to the bottom of the counterweight 14 via a compensation sheave 21.

Drive motor 20 is controlled by a motor controller 26 having a motor control feedback loop 28. the actual speed of the elevator car 12 is detected, such as by a tachometer 30 coupled to the drive motor 20. Tachometer 30 provides an actual speed signal VA, which is used as a feedback signal for a summing point 32. The desired speed of the elevator car 12 at any instant during a run of the elevator car is provided by a speed pattern generator 34, which provides a speed pattern signal VSP for summing point 32. Summing point 32 provides a signal VE equal to the error or difference between the actual speed VA and the desired speed VSP, and this signal is processed and amplified by processing function 36 to provide a current reference signal EX1 whwich represents the motor current which is required to cause the car speed to correctly track the speed pattern.

According to the teachings of the invention, the current reference signal EX1 is added to a load compensation signal LCS' at a summing point 38, with the load compensation signal LCS' being permanently connected to summing point 38 to provide load compensation throughout the entire run of elevator car 12. Thus, the invention, in addition to providing consistently smooth starts, regardless of car loading, also insures consistently accurate and faster landings regardless of car loading. Summing point 38 provides a load compensated current reference signal EX2 for an amplifying and processing function 40, which in turn controls the drive motor current.

Elevator car 12 includes a car or supervisory controller 42 which keeps track of car floor position CP, such as from car position pulses developed by a pulse wheel 44, it keeps track of hall calls from the hall call button system represented by hall call buttons, it keeps track of car calls from the car station 48, and it obtains indications of per cent car loading relative to rated load, such as indicated by signals WT50 and WT75 which go true when the car load is 50% and 75%, respectively, of rated load. Car controller 42 also provides a signal RUN which initiates production of a speed pattern signal VSP by the speed pattern generator 34.

According to the teachings of the invention, a load compensation signal LCS and the per cent car loading signals WT50 and WT75 are provided signal conditioning circuitry 50 which receives a signal L from a transducer 52 carried by elevator car 12. Load compensation signal LCS may be applied directly to summing point 38, or, as shown in FIG. 1, it may be further processed in a processing function 51. Processing function 51 modifies the car load compensation signal LCS according to the error in hoist rope compensation, which in turn is dependent upon the car floor position CP.

Elevator car 12 has a platform 54 which is isolated from the cab and car sling, represented by reference 56, via suitable isolating material indicated by springs 58 and 60. The isolating material may be any resilient material, such as metallic springs, elastomeric material such as a suitable plastic, or combinations thereof, selected to provide a displacement of platform 54 with car load which is as linear as practical. Transducer 52 which provides the signal L responsive to the postion of platform 54, may be any suitable device, such as a linear potentiometer having a stroke which exceeds the maximum deflection of platform 54 over the total possible range of car load and acceleration. Protection for the potentiometer 52 should be provided, such as mechanical stops which limit the maximum deflection of platform 54, to prevent damage thereto during maximum acceleration, as well as in the event of an unusual overload.

Figure 2:
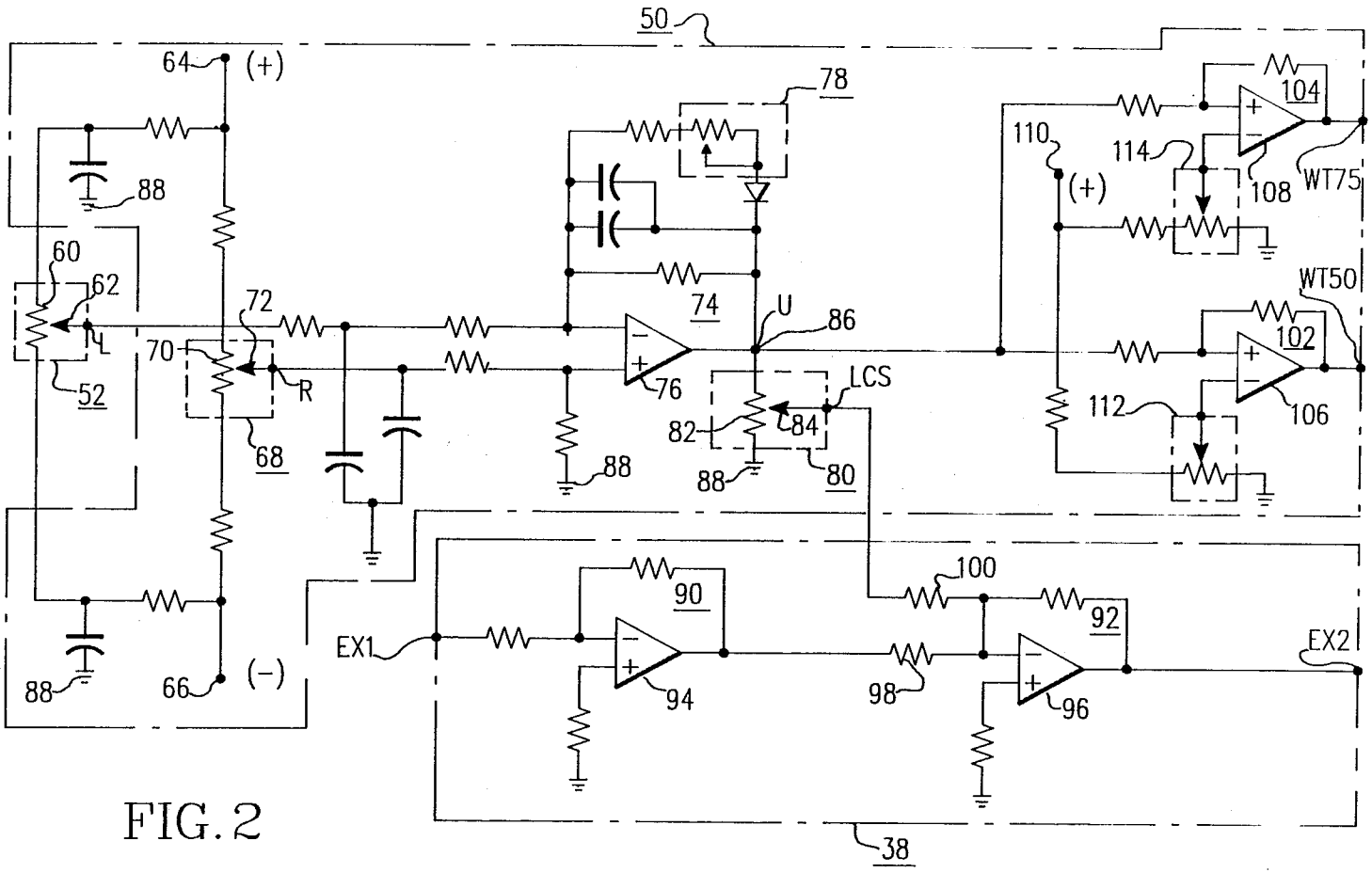
FIG. 2 is detailed schematic diagram of a portion of the car controller of the elevator system shown in FIG. 1, illustrating the development of a load compensation signal for the motor control loop, and car loading signals for car and/or group supervisory control.

FIG. 2 is a schematic diagram of signal conditioning circuitry which may be used for the signal conditioning function shown in FIG. 1. Potentiometer 52 carried by elevator car 12, includes a resistive element 60 and a wiper contact 62. Positive and negative terminals 64 and 66, respectively, of suitble DC power supplies 67 (FIG. 1), are connected to the ends of resistive element 60, and the wiper contact 62 provides a first voltage, referred to as signal L, which is responsive to the position of platform 54.

A second or reference voltage R is provided for comparison with the platform position signal L, and thus the reference voltage R is preferably derived from the same power supply from which signal L is derived. Reference R is also preferably obtained from a potentiometer 68 having a resistive element 70 and a wiper contact 72. Terminals 64 and 66 are connected to the ends of resistive element 70, and signal R is provided by the wiper contact 72.

The difference between singal L and the reference voltage R is amplified and heavily filtered in filter amplifier 74. Filter amplifier 74 may include an operational amplifier 76 having its inverting input connected to receive signal L and its non-inveting input connected to receive the reference voltage R. The feedback network of operational amplifier 76 includes a potentiometer 78 connected to permit adjustment of the gain of the filter amplifier. The degree of filtering of the filter amplifier is selected such that the amplifier's response time is fast enough to follow changes in the loading of elevator car 12, but too slow to affect car dynamics during a run. This aspect of the invention permits the load compensation signal LCS to be permanently connected in the motor control loop 28, eliminating the need for switching the signal out of the control loop after the drive motor is pre-torqued to assume the unbalanced load from the brake, and eliminating the need to store the signal in a memory when it is desired to retain the load compensation signal to improve landing accuracy and reduce landing time.

Filter amplifier 74 provides an output signal U which is applied to a voltage adjuster or potentiometer 80 having a resistive element 82 and a wiper contact 84. Resistive element 82 is connected across the output of amplifier 74, i.e., from terminal 86 to system common or ground 88, and the load compensation signal LCS is provided by wiper contact 84.

Summing point 38, to which the load compensation signal LCS is applied, may include an inverting amplifier 90 and an adder 92. Inverting amplifier 90 includes an operational amplifier 94, and the adder includes an operational amplifier 96. The current reference signal EX1 is applied to the inverting input of opertional amplifier 94, and the output of amplifier 94 is connected to the inverting input of amplifier 96 via resistor 98. The load compensation signal LCS may be added directly to the current reference, as shown in FIG. 2, by connecting signal LCS to the inverting input of amplifier 96 via a resistor 100. As shown in FIG. 1, and as will be hereinafter described, the load compensation signal LCS may be further processed to account for the compensation error to provide a signal LCS', which signal would be applied to the summing point 38. The output of amplifier 96 provides the load compensated current reference signal EX2.

The circuitry shown in FIG. 2 is adjusted according to the teachings of the invention as will now be described, with it being important to follow the recited sequence. First, the linear potentiometer 52 carried by the elevator car 12 is adjusted or calibrated after a balanced load has been placed in the elevator car. For example, iron weights equal to 40% of rated car load may be placed in the car 12, which will cause the weight of car 12 to exactly equal and thus balance the weight of the counterweight 14. With a balanced load in car 12 there will be no unbalanced torque exerted on brake 21. After a balanced load has been placed in car 12, a voltmeter is connected from wiper arm 62 to power supply common or ground 88 and wiper arm 62 is adjusted until the voltmeter indicates zero voltage. Potentiometer 52 is then "locked down" to prevent any future adjustment, as none will be necessary.

The next step is to move elevator car 12 to a floor which represents the mid-point of the hatch 22, retaining the balanced load placed in the car for the first step of the calibrating method. The voltage adjusting potentiometer 80 is set to its maximum position, i.e., such that the wiper arm 84 is closest to the end of the resistive element 82 which is connected to output terminal 86 of amplifier 76. A voltmeter is connected from the wiper contact 72 of potentiometer 68 to system common or ground 88, and wiper arm 72 is adjusted until the voltmeter reads zero volts. Potentiometer 68 is a "trim pot" located in the machine room, and will be periodically readjusted to compensate for permanent deformation or ageing of the resilient materials used to isolate platform 54 from cab 56. In a periodic readjustment, the car 12 will be parked mid-hatch, a balanced load will be placed in the car, and a voltmeter will be connected between wiper arms 62 and 72. Potentiometer 68 will then be adjusted until the voltmeter reads zero volts.

The next steps of the calibrating method compensate for non-linearities in the isolating material, and first requires that the car be parked mid-hatch with a load in the car equal to twice the balance load. For example, if the rated capacity of the car 12 is 2000 pounds, a balanced load would be 40% of 2000 pounds or 800 pounds, and a load equal to twice the balanced load would be equal to 1600 pounds. The car is then repeatedly started and run to an adjacent floor from this mid-hatch floor at different settings of potentiometer 80, until the smoothest starts are obtained. Potentiometer 80 is then "locked down" to prevent accidental future readjustment. The starts may be monitored for smoothness, for example, by placing a recording accelerometer on the car floor i.e., platform 54.

The final step of the method involves removing all load from the elevator car 12 and repeatedly running the car between floors at mid-hatch at different gain settings of the filter amplifier 74. In other words, potentiometer 78 is adjusted until the starts of the elevator car are the smoothest. This completes the calibration procedure, and is hereinbefore stated, only the trim pot 68 need ever be adjusted again, as required to compensate for ageing of the platform isolation material.

Figure 3:
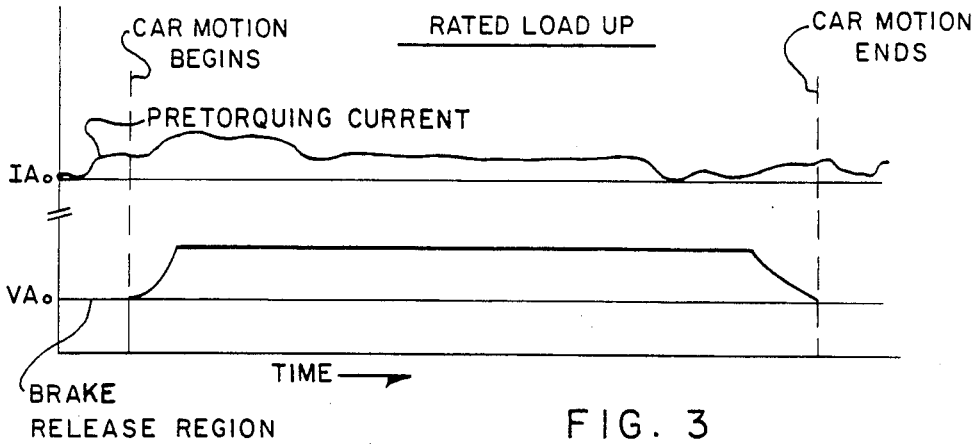
FIGS. 3, 4 and 5 each illustrate motor armature current IA and actual car velocity VA waveforms for runs made from the fourth floor of a building to the ninth floor, for rated car load, balanced car load, and no car load, respectively.
Figure 4:
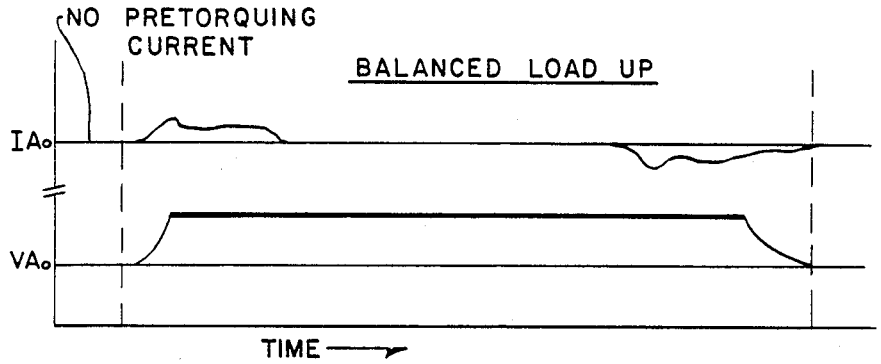
Figure 5:
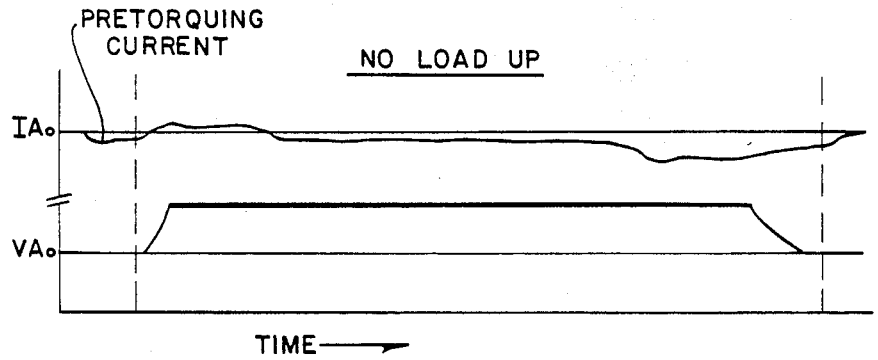

FIGS. 3, 4 and 5 illustrate motor armature current IA and car velocity VA waveforms versus time for rated car load, balanced car load, and no car load, respectively, for runs made in the uptravel direction between the fourth and ninth floors of a building, using car load compensation for the motor control loop of a DC drive motor. The car velocity waveforms VA are magnified to more clearly illustrate car take offs and landings, and thus the waveforms are clipped. It will be noted that with a balanced load, no pre-torquing current is produced, but with rated load up and balanced load up, a pre-torquing current in the proper direction is established prior to car movement to transfer unbalanced brake torque to motor torque, and start the car smoothly without fall back or jerk. The brake starts to release prior to acutal car movement, in the current pre-torquing region, to reduce floor-to-floor travel time, as well as to insure there is no transition from brake to motor at the start of car movement. It will also be noted that the landings are made directly into the floor without unduly long landing times, overshoot, or undershoot, as the load compensation signal LCS also provides load compensation for improving car landings.

Figure 6:
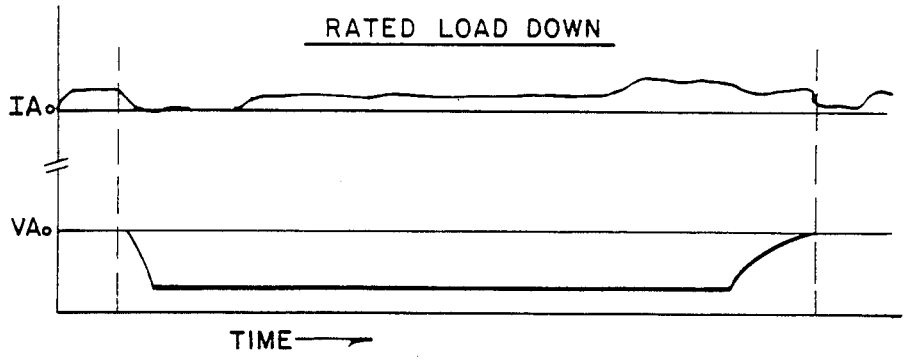
FIGS. 6, 7 and 8 each illustrate motor armature current IA and actual car velocity VA waveforms for runs made from the ninth floor of a building to the fourth floor, for rated car load, balanced car load, and no car load, respectively.
Figure 7:
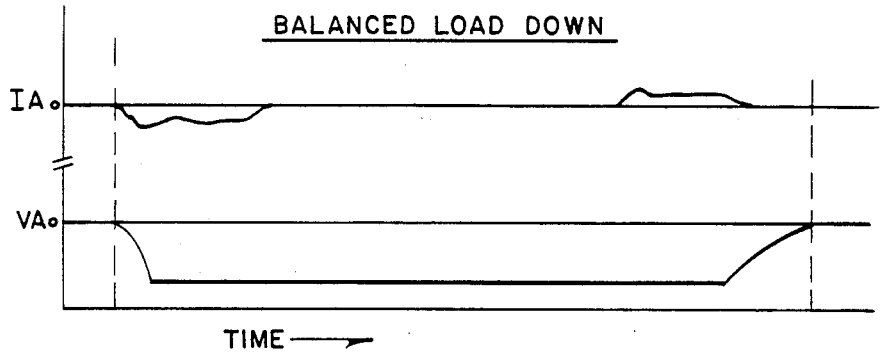
Figure 8:
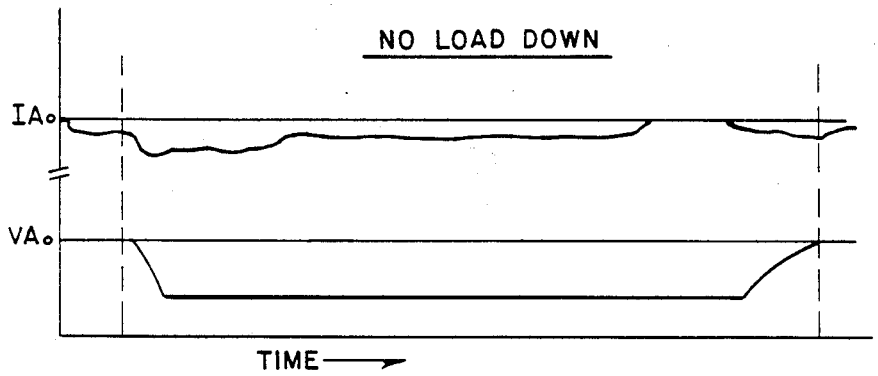

FIGS. 6, 7 and 8 are similar to FIGS. 3, 4 and 5, respectively, except for rungs made in the down direction between the ninth and fourth floors of a building.

Returning now to FIG. 2, the output signal U of the filter amplifier which was used to develop the load compensation signal LCS is also used to develop car load signals WT50 and WT75 for the car controller 42. These functions are easily performed in comparator circuits 102 and 104 which include operational amplifiers 106 and 108, respectively. Signal U is applied to the non-inverting inputs of operational amplifiers 106 and 108, and a positive reference voltage 110 is applied to the inverting inputs via potentiometers 112 and 114, respectively. The wiper arms of potentiometers 112 and 114 are adjusted such that signals WT50 and WT75 will go true when the car load reaches 50% and 75%, respectively, of rated capacity.

Signal U is used directly to provide % load in car 12, relative to rated load or capacity. Signal LCS may be used directly to provide a torque balancing signal for summing point 38, as hereinbefore described relative to FIG. 2. This would be the case when the hoist rope compensation error is insignificant. Signal LCS may alternatively be processed via processing function 51 shown in FIG. 1 to provide a modified compensation signal LCS' which, in addition to compensating for car load also compensates for error in hoist rope compensation, whether or not compensation is actually provided for the weight of the hoist cables. When hoist rope compensation is not used, such as in some outside elevators on hotel walls, the compensation error is of course larger than when compensation chains or cables are provided. There is usually a compensation error, even when compensation is provided, because of the limited number of sizes of compensation chains and ropes.

Figure 9:
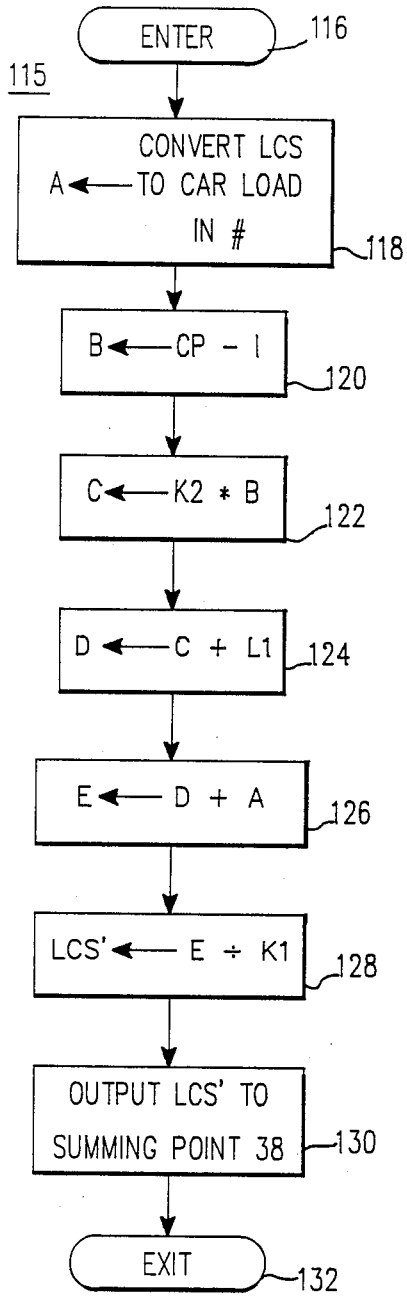
FIG. 9 is a flow chart of a program which sets forth a method for further processing of the load compensation signal developed in the circuitry of FIG. 2, to additionally compensate for errors in hoist rope compensation.
Figure 10:
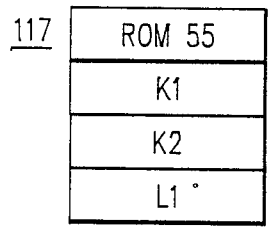
FIG. 10 is a ROM map illustrating certain constants used by the program shown in FIG. 9.
Figure 11:
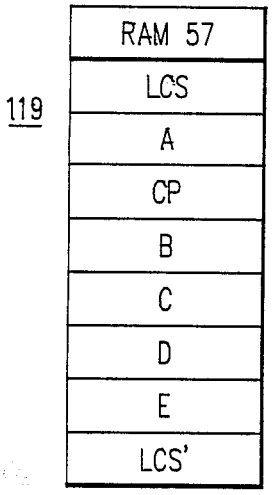
FIG. 11 is a ROM map illustrating certain variables which are stored from time to time by the program shown in FIG. 9.

FIG. 9 illustrates a flow chart of a program 115 which may be used by the processing function 51 shown in FIG. 1. Program 115 is stored in ROM 55. FIGS. 10 and 11 are ROM and RAM maps 117 and 119, respectively, which will be referred to while describing program 115.

Program 115 is entered at 116 when car 12 is loaded and ready to make a run, and also while car 12 is running to update the compensation signal LCS' as car 12 changes its location in the building hatch 22. Step 118 converts signal LCS to car load in pounds and stores the result at a location A in RAM 57, as shown in the RAM map of FIG. 11. This conversion may be calculated, or it may be made by accessing a look-up table specifically prepared for elevator car 12.

Step 120 reads the floor position CP of elevator car 12, which is provided by car controller 42, and step 120 subtracts one from CP and stores the result at location B or RAM 57.

Step 122 obtains a constant K2 from ROM 55 and multiplies it by the value CP-1 stored at location B of RAM 57. Step 122 stores the product at RAM location C. Constant K2 is precalculated for each elevator installation and it is stored in ROM 55, as shown in the ROM map of FIG. 10. K2 is equal to L2 minus L1 divided by one less than the number of floors in the building. L2 is the error in hoist rope compensation when the elevator car 12 is at the top floor of the building, and L1 is the error in hoist rope compensation when the elevator car 12 is at the bottom floor of the building. L1 and L2 are positve when the car side is heavier that the counterweight side, and negative when the counterweight side is the heavier side.

Step 124 adds the constant L1 to the contents stored at location C, and step 124 stores the result at RAM location D.

Step 126 adds the constant stored at locations D and A and stores the sum at RAM location E.

Step 128 divides the sum stored at location E by a constant K1, where K1 is a constant which converts torque to difference in tension between the car side ropes and the counterweight side ropes of the hoist roping 16. This conversion is stored at RAM location LCS' and step 130 outputs the contents stored at LCS' to the summing point 38, with a suitable digital to analog conversion being made if the summing point requires an analog signal. The program then exits at 132. Each time the advanced car position of the elevator car changes, program 115 may be run again to update the value of LCS' for the new car position.

I claim as my invention:

1. A method for providing a load compensation signal for the control loop of an elevator drive motor of a traction elevator system which includes an elevator car and counterweight mounted for movement in the hatch of a building, comprising the steps of:

providing a platform in the elevator car which is movable in response to load, providing a first voltage having a magnitude responsive to the position of the platform, calibrating the first voltage to provide a zero magnitude relative to common when the elevator car has a balanced load, providing a reference voltage, providing a filter amplifier having inputs and an output, applying the calibrated first voltage and reference voltage to the inputs of said filter amplifier, providing voltage adjuster means, connecting the output of said filter amplifier to the control loop of the elevator drive motor via said voltage adjuster means, to provide a load compensation signal, adding the load compensation signal to a current reference signal provided by the control loop, and selecting the magnitude of the filtering provided by the filer amplifier such that the response time of the filter amplifier is fast enough to follow changes in car landing but too slow to affect the dynamics of the elevator car, to permit the load compensation signal to remain in the control loop through out a run of the elevator car.

2. The method of claim 1 including the step of adjusting the reference voltage to provide a zero magnitude relative to common when the elevator car is at mid-hatch with a balanced load.

3. The method of claim 1 including the step of adjusting the voltage adjuster means to cause the elevator car to start smoothly at mid-hatch with twice balanced load.

4. The method of claim 1 including the step of adjusting the gain of the filter amplifier to cause the elevator car to start smoothly at mid-hatch with no load.

5. The method of claim 2 wherein the step of adjusting the refernce voltage includes the step of:

setting the voltage adjuster means to its maximum value during said adjusting step.

6. The method of claim 3 wherein the step of adjusting the voltage adjuster means includes the step of:

initiating the adjustment from the minimum value of the voltage adjuster means.

7. The method of claim 1 wherein the elevator system includes supervisory control which utilizes per cent car loading in the operating strategy for the elevator car, and including the step of:

processing the output of the filter amplifier to provide at least one signal indicative of per cent car loading.

8. The method of claim 2 including the step of:

readjusting the reference voltage periodically to provide a zero difference in potential between the first and reference voltages when the elevator car is at midhatch with a balanced load, to compensate for changes in platform position with time.

9. The method of claim 1 wherein the steps of providing the first and reference voltages include the steps of:

connecting first and second potentiometers between the terminals of a power supply, and providing the first and reference voltages from said first and second potentiometers, respectively.

10. The method of claim 1 wherein the traction elevator system is devoid of compensation for compensating for the weight of the hoist roping, and including the step of modifying the load compensation signal for car position and lack of hoist cable compensation.

11. The method of claim 1 wherein the traction elevator system includes compensation for compensating for the weight of the hoist roping, with predetermined hoist rope compensation errors at the travel limits of the elevator car, and including the step of modifying the load compensation signal for car position and hoist cable compensation error at said position.

12. A traction elevator system comprising:

an elevator car, a counterweight, a building having a hatch, means mounting said elevator car and counterweight for guided movement in th hatch of said building, including a drive motor having a control loop which includes a current reference, means including a load responsive platform in the elevator car for providing a first voltage responsive to load in the elevator car with said first voltage having a zero magnitude relative to common when the elevator car has a load which causes the elevator car to balance the counterweight, means providing a second voltage having an adjustable magnitude, with said second voltage being initially adjusted to provide a zero magnitude relative to common when the elevator car is at mid-hatch with a balanced load, a filter amplifier having inputs, an output, and a predetermined degree of filtering, said first and second voltges being connected to inputs of said filter amplifier, voltage adjuster means connected to the output of said filter amplifier, said voltage adjuster means providing a load compensation signal, means adding said load compensation signal to the current reference signal of the control loop thorughout a run of said elevator car, to aid starting and landing of said elevator car., said predetermined degree of filtering being selected such that said filter amplifier has a response time adequate to follow changes in car loading, but too slow to adverely affect car dynamics, said voltage adjuster means being adjusted such that the elevator car will start smoothly at mid-hatch with twice balanced load, and including means for adjusting the gain of said filter amplifier, with said gain being adjusted such that the elevator car will start smoothly at mid-hatch with no load.

13. The elevator system of claim 12 including:

supervisory control for the elevator car which utilizes car loading in the operating strategy for said elevator car, and means for processing the output of the filter amplifier to provide at least one signal indicative of car loading.

14. The elevator system of claim 12 wherein the means providing the first and second voltages include first and second potentiometers connected between the terminals of a power supply, with at least the first potentiometer being carried by the elevator car.

15. The elevator system of claim 12 wherein there is a car position dependent hoist cable weight compensation error, adn including means for processing the load compensation signal before it is added to the current reference signal of the control loop, to compensate for said hoist cable compensation error.

* * * * *